US010933523B1

(12) United States Patent
Obitts et al.

(10) Patent No.: US 10,933,523 B1
(45) Date of Patent: Mar. 2, 2021

(54) APPARATUS TO ASSIST A MECHANIC TO WORK ON THE ENGINE OF A VEHICLE

(71) Applicant: Whiteside Mfg. Co., Delaware, OH (US)

(72) Inventors: Shane Obitts, Elyria, OH (US); Kirt E. Whiteside, Delaware, OH (US); Robert E. Studer, New Washington, OH (US); Keith R. Studer, Shelby, OH (US)

(73) Assignee: WHITESIDE MFG. CO., Delaware, OH (US)

( * ) Notice: Subject to any disclaimer, the term of this patent is extended or adjusted under 35 U.S.C. 154(b) by 0 days.

(21) Appl. No.: 16/533,965

(22) Filed: Aug. 7, 2019

Related U.S. Application Data

(60) Provisional application No. 62/715,856, filed on Aug. 8, 2018.

(51) Int. Cl.
*B25H 5/00* (2006.01)
*B25H 1/00* (2006.01)
*E06C 1/38* (2006.01)

(52) U.S. Cl.
CPC ..... *B25H 5/00* (2013.01); *B25H 1/0007* (2013.01); *E06C 1/38* (2013.01)

(58) Field of Classification Search
CPC ... B62D 7/20; B62K 5/00; B25H 5/00; B25H 1/00; B25H 1/0007; A63B 22/203
See application file for complete search history.

(56) References Cited

U.S. PATENT DOCUMENTS 2,701,168 A * 2/1955 Schemers ..... B62B 3/10 182/116
2,872,252 A * 2/1959 Konkle ..... B25H 5/00 182/131
2,969,123 A * 1/1961 Jamerson ..... B25H 5/00 182/116
6,105,719 A * 8/2000 Lensing ..... E06C 1/397 182/116
6,540,301 B1 * 4/2003 Bottoms ..... A47C 9/025 135/65
6,641,146 B2 * 11/2003 Reese ..... B25H 5/00 182/116
6,824,149 B1 * 11/2004 Whitlock ..... B25H 5/00 280/32.6
6,957,718 B1 10/2005 Whiteside et al.
8,151,937 B2 * 4/2012 Blemel ..... A47C 9/027 182/115
8,496,292 B2 * 7/2013 Strassberg ..... A47C 7/62 297/195.11

* cited by examiner

*Primary Examiner* — James A Shriver, II
*Assistant Examiner* — James J Triggs
(74) *Attorney, Agent, or Firm* — Renner Kenner Greive Bobak Taylor & Weber

(57) ABSTRACT

An apparatus which enables a person to comfortable work on the engine of a vehicle includes base, spine, post, knee pad, and chest pad components. The spine component is pivotally connected to the base component. A brace prevents the pivoting movement but is removably connected between the spine and the base to allow pivoting when desired. The spine component carries the tube component at a selected height, and the tube component carries the knee pad component at a selected position. The tube component carries the chest pad component.

10 Claims, 3 Drawing Sheets

APPARATUS TO ASSIST A MECHANIC TO WORK ON THE ENGINE OF A VEHICLE

CROSS-REFERENCE TO RELATED APPLICATION

This application claims the benefit of U.S. Provisional Application No. 62/715,856 filed Aug. 8, 2018, the contents of which are incorporated herein by reference.

TECHNICAL FIELD

This invention relates to a device for use by a mechanic, or the like, to conveniently and comfortably work on the engine of a vehicle. More particularly, this invention relates to such a device which can be folded for compact storage.

BACKGROUND ART

Servicing the engine of a vehicle can be very hard on the body of a mechanic. Specifically, with his feet on the ground, to service an engine of a vehicle, the mechanic must lean over a fender or bumper of the vehicle to gain access to the engine from the side or the front of a vehicle. Such can put undue stresses on the back, legs and other parts of the body of the mechanic, particularly when a lengthy repair is involved. These problems are compounded when work is to be done on the engine of a truck or other large vehicle where access to the engine is more elevated. In these instances, the mechanic may have to attempt to work from a ladder or the like which is not only awkward but also presents potential safety problems.

Several devices have been designed in an attempt to solve these problems. One of the more successful devices is shown and described in U.S. Pat. No. 6,957,718. This device included steps to elevate the user and a chest pad for the comfort of the user. In addition, that device provided with means to adequately adjust its height, but it lacked features providing total comfort for the user. In particular, the knees of the user could be irritated after extended use. Moreover, such prior art devices are bulky and take up significant space when stored.

Thus, the need exists for a comfortable and safe device to assist in working on the engine of a vehicle, and a device which can be compactly stored.

DISCLOSURE OF THE INVENTION

It is thus an object of one aspect of the present invention to provide a device which is comfortable to use while servicing an engine of a vehicle.

It is an object of another aspect of the present invention to provide a device, as above, in which a chest pad and knee pads are provided.

It is an object of an additional aspect of the invention to provide a device which can be rendered compact for storage.

These and other objects of the present invention, as well as the advantages thereof over existing prior art forms, which will become apparent from the description to follow, are accomplished by the improvements hereinafter described and claimed.

In general, an apparatus to enable a person to work on the engine of a vehicle includes a base portion adapted to rest on the ground. A spine portion is pivotally carried by the base portion and a post portion is carried by the spine portion. A knee pad portion and a chest pad portion are carried by the post portion.

An apparatus to enable a person to work on an engine according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
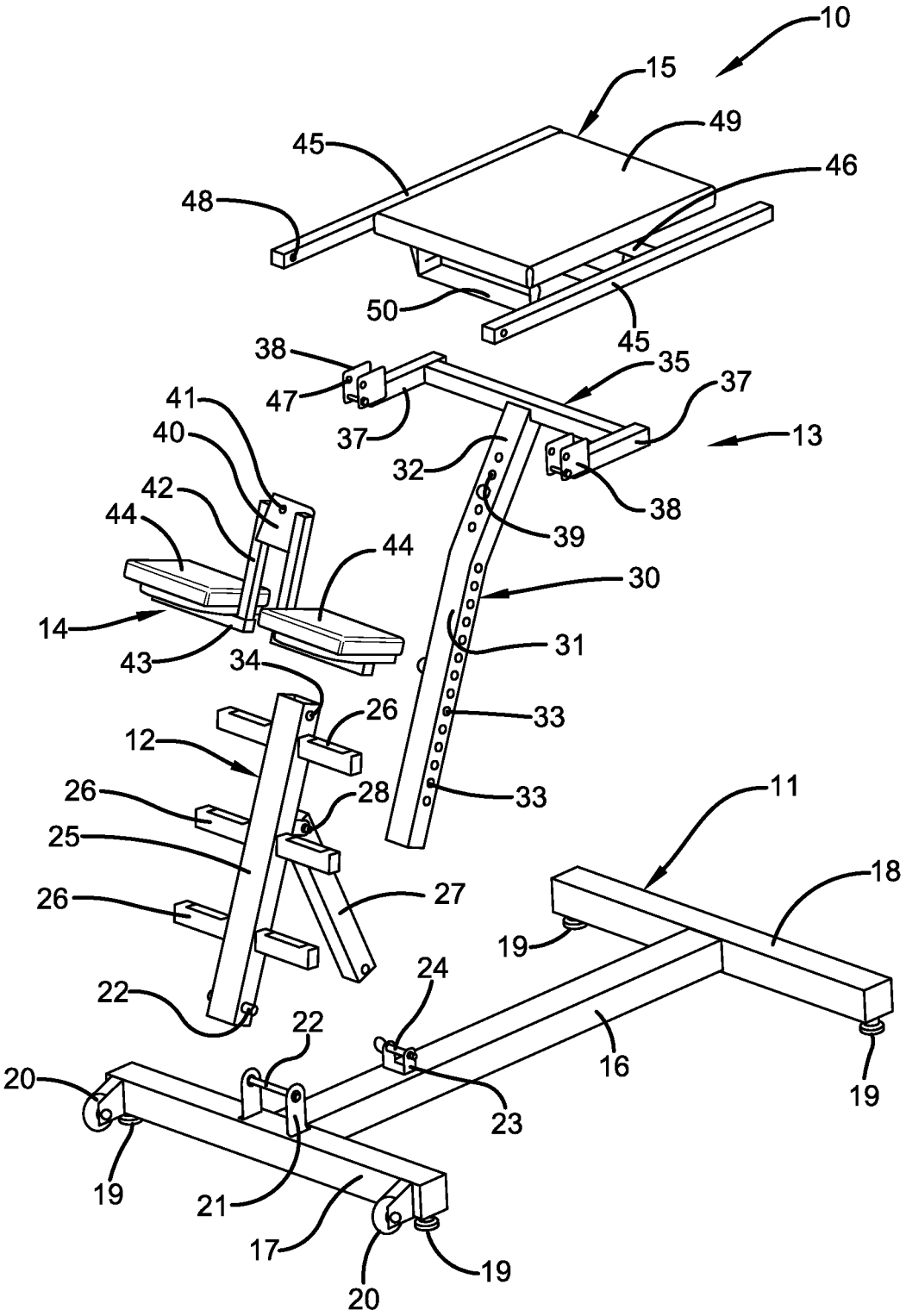
FIG. 1 is an exploded perspective view showing the major components of a device to assist a mechanic in servicing the engine of a vehicle made in accordance with the present invention.
Figure 2:
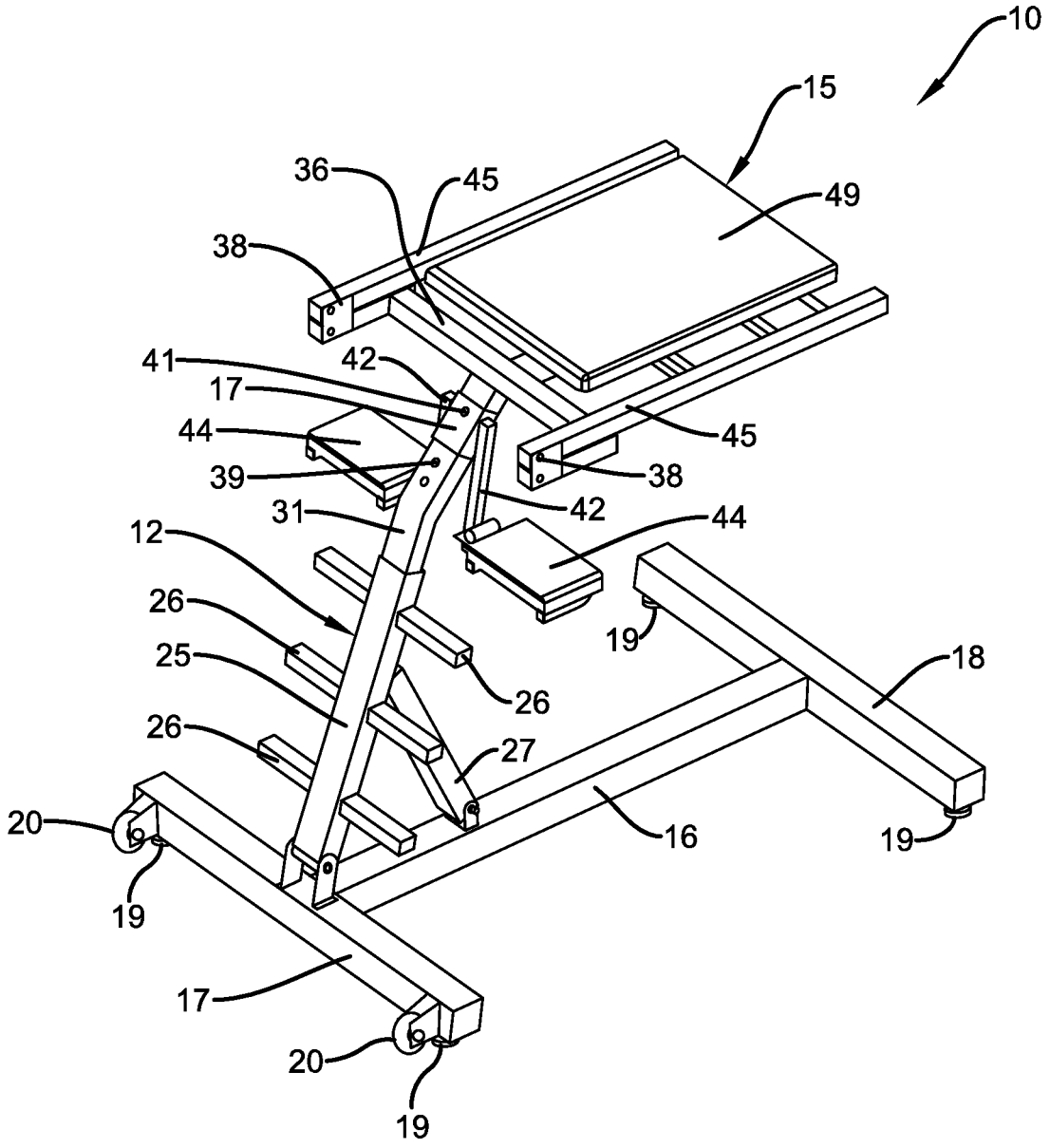
FIG. 2 is a perspective view of the device assembled.

A device to assist a mechanic while working on the engine of a vehicle is shown assembled in FIG. 2 and is generally indicated by the numeral 10. Device 10 includes a base portion generally indicated by the numeral 11, a spine portion generally indicated by the numeral 12, a post portion generally indicated by the numeral 13, a knee pad portion generally indicated by the numeral 14, and a chest pad portion generally indicated by the numeral 15.

Figure 3:
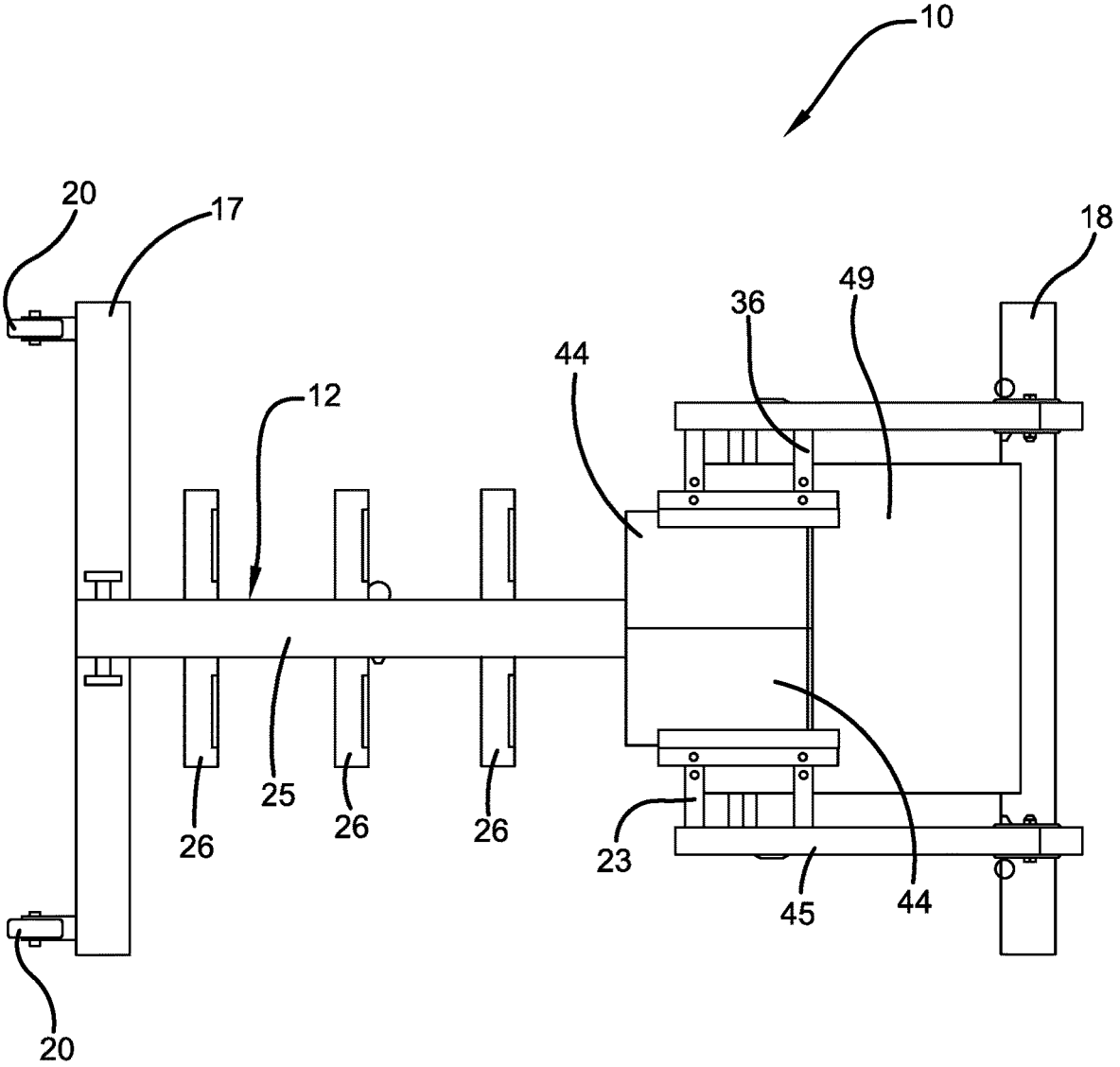
FIG. 3 is a plan view of the device of FIG. 2 folded for storage.

Base portion 11 is generally I-shaped having a central beam 16 with branches 17 and 18 carried at each end thereof. The outer ends of each branch 17 and 18 are provided with feet 19 which support base portion 11 which in turn supports the rest of device 10. Wheels 20 extend laterally from the ends of branch 17 and, as will be hereinafter described, wheels 20 enable the user to easily transport device 10 when it is folded as shown in FIG. 3. A clevis connection 21 extends upwardly from branch 17, and it permanently carries a pin 22 about which spine portion 12 is connected to render spine portion 12 pilotable with respect to base portion 11, as will hereinafter be described in more detail. Beam 16 also carries a clevis connection 23 which receives a removable pin 24 to connect base portion 11 to spine portion 12 in a manner to be hereinafter described.

Spine portion 12 includes a hollow tube 25 which carries a plurality of spaced steps 26 extending outwardly from tube 25. As previously described, spine portion 12 is pivotally connected to base portion by its connection to pin 22. However, a hollow brace 27 can selectively prohibit or allow such rotation. To that end, brace 27 is pin connected at one end, as at 28, to tube 25 so that it can pivot with respect to tube 25. The other end of brace 27 receives pin 24 through aperture 29 to connect tube 25 to beam 16 of base portion 11. When pin 24 is removed, spine portion 12 can pivot on pin 22, but when pin 24 is in place through aperture 29 and an opposed aperture in brace 27, rotation of spine portion 12 is prohibited.

Post position 13 includes a hollow tube generally indicated by the numeral 30. Tube 30 includes a lower segment 31 and an upper segment 32 extending angularly upwardly from segment 31. Lower segment 31 is slidably received in tube 25 of spine portion 12 and is provided with a plurality of spaced through apertures 33. To connect lower segment 31 to tube 25, a through aperture 34 in tube 25 is aligned with a selected one of the through apertures in lower segment 31, and the tube 25 is connected to the lower segment 31 by a pin (not shown) extending through an apertures 33 and 34. As a result, the height of post portion 13 relative to spine portion 12 can be adjusted as necessary dependent on the height of the vehicle being serviced.

A U-shaped frame, generally indicated by the numeral 35, is carried at the top of upper segment 32. The base 36 of frame 35 is connected to the top of upper segment 32, and spaced branches 37 of frame 35 extend rearwardly from the ends of base 36. The ends of branches 37 each carry clevis plates 38 which carry chest pad portion 15 as will be hereinafter described.

Upper segment 32 of tube 30 is provided with a plurality of spaced through holes 39 which are oriented on tube 30 generally ninety degrees of through apertures 33. Through holes 39 enable post portion 13 to be attached to knee pad portion 14 as will now be discussed.

Knee pad portion 14 includes a plate 40 having an aperture 41 therethrough. Aperture 41 can be aligned with one of the holes 39 for attachment of knee pad portion 14 to post portion 13, as by bolts or the like. Plate 40 carries opposed rods 42 which in turn each carry frames 43. Each frame carries a knee pad 44. As a result, the height of the position of knee pads 44 may be adjusted dependent on the hole 39 selected for mounting.

Chest pad portion 15 includes opposed arms 45 which are connected by slats 46. One end of each arm 45 is provided with an aperture 47, and arms 45 are received between clevis plates 38 such that apertures 47 align with holes 48 in clevis plates 38. With such alignment, arms 45 may be attached to clevis plates 38 by any suitable means, such as bolts, resulting in the pad portion 15 being carried by post portion 13. A chest pad 49 is carried by slats 46, and a drawer support 50 receives a drawer for holding tools or the like. The drawer may be slid forwardly from under pad 49 for access to its contents.

A user may adjust the position of knee pads 44 and chest pad 49 and may adjust the height of device 10, all as previously described, as desired, and then he can climb spine portion 12 on steps 26, place his knees on pads 44, and lean over placing his chest on pad 49. While in that position, he may reach down to comfortably service the engine below.

When there is no current need for device 10, it may be folded to a flat compact configuration for convenient storage. To that end, the pin connection between brace 27 and post portion 13 is removed such that spine portion 12 may be rotated clockwise, as viewed in FIG. 2, down onto base portion 11. Chest pad assembly 15 may then be rotated counterclockwise, as viewed in FIG. 2, onto the top of spine portion 12 to create the folded condition shown in FIG. 3.

It should thus be appreciated that a device as described herein accomplishes the objects of the invention and otherwise substantially improves the art.

What is claimed is:

1. An apparatus to enable a person to work on the engine of a vehicle comprising a base portion adapted to rest on the ground, a spine portion pivotally carried by said base portion, a post portion carried by said spine portion, a knee pad portion carried by said post portion, a plurality of steps carried by said spine portion below said knee pad portion, and a chest pad portion pivotally carried by said post portion, said spine portion being rotated onto said base portion and said chest pad portion being rotated onto said spine portion so that the apparatus can be folded from an upright to a flat horizontal position.

2. The apparatus of claim 1 wherein said spine portion includes a tube and said post portion includes a tube received within said tube of said spine portion.

3. The apparatus of claim 2 wherein said spine portion includes a brace removably connected to said base portion such that when said brace is connected to said base, said spine portion cannot pivot with respect to said base portion.

4. An apparatus to enable a person to work on the engine of a vehicle comprising a base portion adapted to rest on the ground, a spine portion pivotally carried by said base portion and including a tube, a post portion carried by said spine portion and including a tube received within said tube of said spine portion, a knee pad portion carried by said post portion, and a chest pad portion pivotally carried by said post portion, said spine portion including a brace removably connected to said base portion such that when said brace is connected to said base, said spine portion cannot pivot with respect to said base portion, said brace being pivotally connected to said tube so that said brace may pivot with respect to said tube when said brace is not connected to said base portion, said spine portion being rotated onto said base portion and said chest pad portion being rotated onto said spine portion so that the apparatus can be folded from an upright to a flat horizontal position.

5. The apparatus of claim 2 wherein said tube of said spine portion has at least one aperture therethrough and said tube of said post portion has a plurality of apertures therethrough, one of said apertures of said tube of said post portion being selectively aligned with said aperture of said spine portion, and wherein a pin is received through said aligned apertures to establish the relative position of said tubes.

6. An apparatus to enable a person to work on the engine of a vehicle comprising a base portion adapted to rest on the ground, a spine portion pivotally carried by said base portion and including a tube, a post portion carried by said spine portion and including a tube received within said tube of said spine portion, a knee pad portion carried by said post portion, and a chest pad portion carried by said post portion, said tube of said spine portion having at least one aperture therethrough and said tube of said post portion having a plurality of apertures therethrough, one of said apertures of said tube of said post portion being selectively aligned with said aperture of said spine portion, wherein a pin is received through said aligned apertures to establish the relative position of said tubes, and wherein said tube of said post portion has a plurality of holes therethrough, said knee pad portion including a frame having at least one aperture therein, one of said holes of said post portion being selectively aligned with said aperture of said knee pad portion so that said knee pad portion can be connected to said post portion at a selected position.

7. The apparatus of claim 6 wherein said frame carries knee pads.

8. An apparatus to enable a person to work on the engine of a vehicle comprising a base portion adapted to rest on the ground, a spine portion pivotally carried by said base portion and including a tube, a post portion carried by said spine portion and including a tube received within said tube of said spine portion, a knee pad portion carried by said post portion, a plurality of steps carried by said spine portion below said knee pad portion, a chest pad portion carried by said post portion, said tube of said post portion carrying a frame, said chest pad portion including spaced arms adapted to be connected to said frame, a pad carried by said arms, and a drawer positioned under said pad.

9. The apparatus of claim 1, said base portion being supported by a plurality of feet.

10. The apparatus of claim 1 wherein said base portions is provided with wheels to render the apparatus mobile.

* * * * *